United States Patent [19]

Eppley et al.

[11] Patent Number: 4,941,845

[45] Date of Patent: Jul. 17, 1990

[54] DATA TRANSFER CABLE

[75] Inventors: Mark Eppley, Bothell; Peter B. Rysavy, Seattle, both of Wash.

[73] Assignee: Traveling Software, Inc., Bothell, Wash.

[21] Appl. No.: 362,703

[22] Filed: Jun. 7, 1989

[51] Int. Cl.[5] ..... H01R 11/03

[52] U.S. Cl. ..... 439/505; 439/502; 361/428

[58] Field of Search ..... 439/502, 503, 504, 505, 439/506, 359, 362, 623, 638, 639, 640, 650, 652, 676; 361/413, 428; 174/72 A, 72 R; 307/144; 320/7

[56] References Cited

U.S. PATENT DOCUMENTS

| | | | |
|---|---|---|---|
| 4,456,319 | 6/1984 | Poulain Ricros | 439/359 |
| 4,579,407 | 4/1986 | Shimada | 439/502 |
| 4,602,164 | 7/1986 | Gore, III et al. | 361/393 |

OTHER PUBLICATIONS

Rupp Brothers Exceptional Computer Products Instruction Manual, *Fastwire II The Power Connection,* Copyright 1986–1988.

White Crane Systems, *The Brooklyn Bridge,* Copyright 1986, 1988.

Traveling Software Brochure, *Laplink.*

*Primary Examiner*—Eugene F. Desmond

*Assistant Examiner*—Walter G. Hanchuk

*Attorney, Agent, or Firm*—Christensen, O'Connor, Johnson & Kindness

[57] ABSTRACT

A cable assembly including electrically isolated longer cables connected along a portion of their lengths. Serial and parallel connectors are provided at the appropriate ends of the cables while a shorter cable connects another serial connector to the serial connector at each end of one of the longer cables.

6 Claims, 1 Drawing Sheet

DATA TRANSFER CABLE

BACKGROUND OF THE INVENTION

This invention relates generally to devices for interconnecting data processing devices. More specifically it relates to cable means for interconnecting computers to permit the bilateral transfer of data.

With the increasing usage of different sizes of computers for both personal and business use there has come a need to transfer information from one kind of a computer to another. For instance an individual may, while traveling, use a laptop and desire, when arriving at a particular location, to transfer information to a desktop computer.

A problem, however, is that the I/O terminals for the devices may not be mechanically compatible or that on some occasions data may have to be transferred either in a serial or parallel mode. A useful interconnecting device should be able to accommodate all of these needs.

Examples of a prior art device known to the applicant is the interconnecting cable sold by Traveling Software of Bothell, Wash., the assignee of this application, as a part of its "Laplink" software package. This assembly includes a cable having serial input and output connectors of one configuration at each end and of shorter cables mechanically and electrically connected to each connector having connectors of a different configuration at their respective ends. Another connecting device known to the applicant is sold under the name of Fastware II by Rupp Brothers having an address in New York City. This includes a cable connecting two different types of serial connectors at each end of a cable. Still another is a parallel cable sold by White Crane Systems, Inc. of Norcross, Ga. Each of these devices offers limited capability to the user.

Therefore, it is an object of this invention to provide a novel interconnecting cable capable of being used in a number of different ways to interconnect computers.

A further object of this invention is to provide a novel interconnecting cable capable of being used to transfer data either in a parallel or serial mode.

A still further object of this invention is to provide a novel interconnecting cable capable of interconnecting computers having different mechanical configurations at their input/output terminals.

BRIEF SUMMARY OF THE INVENTION

The foregoing and other objects are achieved by a cable arrangement including separate cables held together along their lengths by grommets and/or other securing means and having at their ends connectors compatible with either the serial or parallel terminals of computing devices or their peripherals and also having at each end a short cable for connecting one of the cables to a device having a different mechanical configuration at its input/output terminals.

BRIEF DESCRIPTION OF THE DRAWINGS

The invention itself is set forth in the claims appended hereto while an understanding of an embodiment thereof may be had by reference to the detailed description in conjunction with the drawing in which:

DETAILED DESCRIPTION OF THE PREFERRED EMBODIMENT

Figure 1:
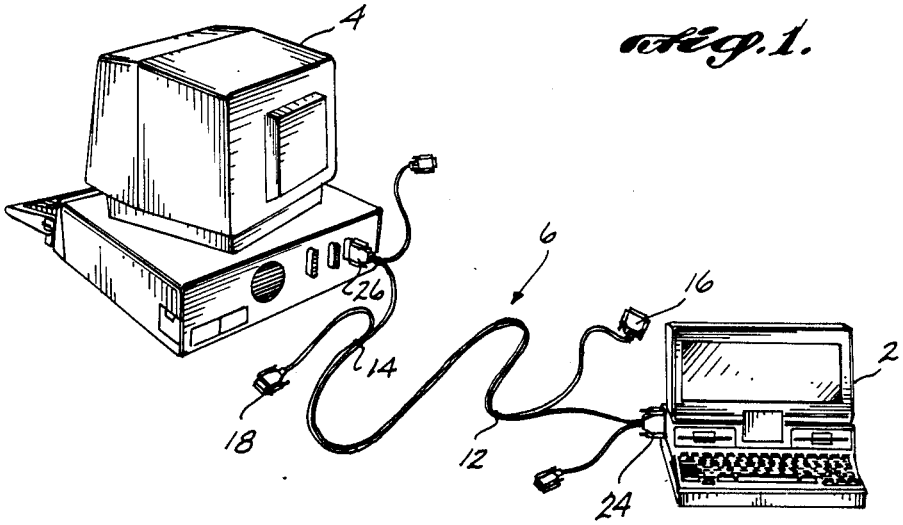
FIG. 1 illustrates the use and environment of the invention.
Figure 2:
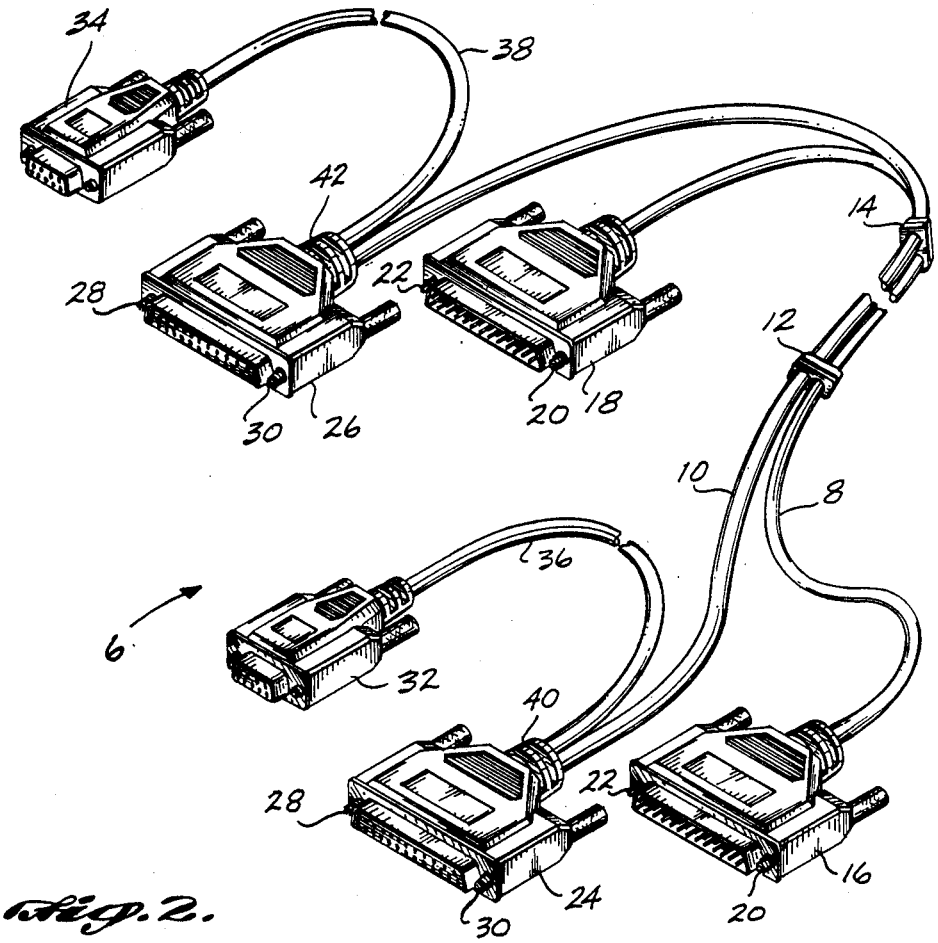
FIG. 2 illustrates an embodiment of the invention.

FIG. 1 shows a particular manner of use for the invention. In this Figure, it is desired to transfer data to and from a laptop computer 2 connected to a desktop 4. In this case, the data transfer is to take place serially and serial connectors forming a part of the invention are used for that purpose.

FIG. 1 illustrates an embodiment of the invention. As may be seen it is constituted by a cable assembly 6 consisting of a pair of cables 8 and 10 each electrically isolated from each other. Grommets 12 and 14 are provided adjacent the opposite ends of the cables to aid in holding them together. Further, portions of the cables may be bonded together along their lengths between the grommets in order to facilitate the manipulation of them by a user. This may be done by heating slightly the plastic forming the outer insulation of each cable to cause the cables to fuse.

Secured to the opposite ends of the cable 8 are connectors 16 and 18. Each of these connectors are provided with a plurality of male terminals and are particularly adapted to permit the transfer of data in parallel. One particular use of these connectors and associated cable is to permit a computer to transfer data to and from a printer port on another computer. Each connector is formed with threaded attaching elements 20 and 22 on their opposing sides to provide for a secure attachment of the connector to the components desired.

Likewise, similar connectors 24 and 26 are provided on opposite ends of the cable 6 and include threaded attaching elements 28 and 30. In this case the connectors 24 and 26 are formed with female terminals to permit the transfer of data serially from one element to another, for instance from a laptop to and from a desktop computer.

The utility of the invention is further enhanced by the provision of additional connectors 32 and 34 connected by cables 36 and 38, respectively, to the connectors 24 and 26. The cables from the connectors 32 and 34 are relatively short compared to the cables 8 and 10 and enter the connectors 24 and 26 directly through the strengthening bosses 40 and 42 formed where the cable 10 enters the connectors. The connectors 32 and 34 are constructed to permit the serial transfer of data but have a different terminal configuration than that of the connectors 24 and 26.

In accordance with present standards providing for compatibility with IBM compatible personal computers, the connectors 16, 18, 24 and 26 are provided with twenty-five terminals while the connectors 32 and 34 have nine. Because the connectors 32 and 34 are both electrically and mechanically connected to the connectors 24 and 26 respectively, a number of different connections are possible. For instance, the nine pin connector 34 could be connected to a port on one computer while the twenty-five pin connector 24 could be connected to a port on another computer. The inclusion of the connectors 16 and 18 because they can be connected to the printer ports of a computer and are used when it is desired to transfer data in the parallel mode.

The assembly therefor is a unitary cable connector assembly capable of being used in a variety of ways to link various types of computers and peripheral components.

It is intended by the claims appended here to cover all embodiments of the inventions as come within their scope.

What is claimed as new is:

1. A cable assembly for use for transferring data between computers and/or associated devices comprising:

a pair of cables, each cable having a connector at its opposite ends for attachment to a computer or an associated device, the connectors on one cable constructed to permit the transfer of data in parallel, the connectors on the other cable constructed to permit the transfer of data serially, means for holding said cables together for a portion of the distance along their lengths, additional cables electrically connected to said serial connectors and shorter in length than the cables in said pair of cables, and a serial connector on the free end of each of said additional cables.

2. A cable assembly as set forth in claim 1, wherein said last mentioned serial connectors have a mechanical configuration different from that of said first mentioned serial connectors.

3. A cable assembly as set forth in either claim 1 or claim 2, wherein said pair of cables are fused together over a portion of their lengths.

4. A cable aassembly as set forth in claim 3, wherein said pair of cables are held together by grommets spaced from the connectors at their ends whereby their portions between said grommets and said connectors are capable of independent movement.

5. A cable assembly as set forth in either claim 1 or claim 2, wherein each connector is provided with means to secure it to a computer or an associated device.

6. A cable assembly as set forth in claim 5, wherein said securing means comprises threaded fasteners on opposing sides of each connector.

* * * * *